United States Patent [19]

McCoy et al.

[11] 4,433,683

[45] Feb. 28, 1984

[54] EXERCISE-MASSAGING DEVICE

[75] Inventors: Kenneth H. McCoy, Santa Monica, Calif.; John Romain, 1629 Veteran Ave., Los Angeles, Calif. 90074

[73] Assignee: John Romain, Los Angeles, Calif.

[21] Appl. No.: 278,636

[22] Filed: Jun. 29, 1981

[51] Int. Cl.[3] ..... A61H 15/00

[52] U.S. Cl. ..... 128/57

[58] Field of Search ..... 128/33, 36, 57, 67, 128/60, 61; 272/67, 137, 141, 127

[56] References Cited

U.S. PATENT DOCUMENTS

| | | | |
|---|---|---|---|
| 1,817,077 | 8/1931 | Gustaveson | 128/57 |
| 1,882,490 | 10/1932 | Falck | 128/57 |
| 2,582,686 | 1/1952 | Fabio | 128/57 |
| 3,616,794 | 11/1971 | Gromala | 128/57 |
| 3,938,803 | 2/1976 | Wilmoth | 272/127 |

FOREIGN PATENT DOCUMENTS

| | | | |
|---|---|---|---|
| 12929 | of 1887 | United Kingdom | 272/141 |
| 275261 | 3/1928 | United Kingdom | 272/127 |
| 1534013 | 11/1978 | United Kingdom | 128/57 |

*Primary Examiner*—Richard J. Apley
*Assistant Examiner*—David J. Brown
*Attorney, Agent, or Firm*—Cislo, O'Reilly & Thomas

[57] ABSTRACT

A hand-held, easily maniputable exercise-massage device which enables the user to not only engage in arm and upper body exercise, but also allows for use of the device as a rolling or massaging implement for reducing tension and relieving body aches and pains. The device essentially comprises opposed spring-biased handle portions having mounted therebetween a plurality of roller members so that the user may distend the handles to obtain arm and hand exercising and may use the device for rolling action on the back of the neck or the like, to relieve tension, knotted muscles and, generally, impart a relaxing sensation to the user.

9 Claims, 5 Drawing Figures

EXERCISE-MASSAGING DEVICE

BACKGROUND OF THE INVENTION

In today's "fast-lane" world, the demands of every day living and the sedentary form of living necessitates and dictates economically constructed, feasibly-used devices that enable mankind to obtain the needed exercises and to relieve the stresses and strains of the chaotic, frenetic pace which all workers in modern society face.

The device of the invention is a relatively small, easily constructed, unsophisticated mechanism which fulfills in an easily affordable manner, all of the needs of a device as alluded to hereinbefore.

The device of the invention comprises essentially two handle members supported on a rigid or flexible extending member, rod or shaft in a spring-biased fashion wherein the handle members are easily grasped by the human hands and having mounted between the handles a plurality or series of rotatable elements in side-by-side relationship so that the device may be used for exercising and/or massaging either independently or at the same time.

The device of the invention is small, uncomplex and easily manufactured and, because of its size, capable of being used in the office environment, at home, on trips or other locations where more sophisticated devices and apparatuses would not be feasible for use.

OBJECTS AND SUMMARY OF THE INVENTION

It is an object of the invention to provide an easily portable exercise-massage device that is of relatively low cost and easy to use.

It is another important object of the invention to provide an exercise-massage device that may be carried easily and in a facile manner for a multitude of end uses.

It is still another important, and more specific object of the invention to provide an exercise-massage device comprising a pair of opposed handles spring-biased mounted on a shaft or extending member either rigid or flexible, and having a plurality or at least one rotatable element therebetween, so that the device may be used in an exercise fashion by distending the handle members away from and towards the rotatable member, or, alternatively, used as a massage-device wherein the roller member may be used to knead or otherwise placate tight and tired muscles, as for example, behind the neck of a human being.

It is another even more specific and further object of the invention to provide a hand-held exercise-massage device which employs handle members mounting therebetween a plurality of rollers, wherein the device may be used like a rolling pin, or the like, to rid the body of pent-up stress or strain, or other tightness which is easily dissipated by engaging in massage or exercise type of action.

It is another, even more specific important object of the invention to provide an exercise-device that is of relatively low cost, simple in design and easy to use, to achieve a plurality of upper body and torso related exercises which are beneficial to engage in.

In an exemplary embodiment the invention relates to an exercise-massage device comprising the combination of an elongate support member defining an axis and having handle means secured to the ends thereof, and wherein at least one rotatable element is mounted on the elongate support member and adapted to impart a massaging action to that portion of the body to which it is applied. The handle members are mounted in spring-biased fashion and are capable of movement along said axis toward and away from said at least one rotatable element so that one may use the device in exercise fashion to exercise the hand, arms and upper torso of the human body.

These and further objects of the invention will become apparent from the hereinafter following commentary taken in conjunction with the drawing.

DESCRIPTION OF THE BEST EMBODIMENT CONTEMPLATED

Figure 1:
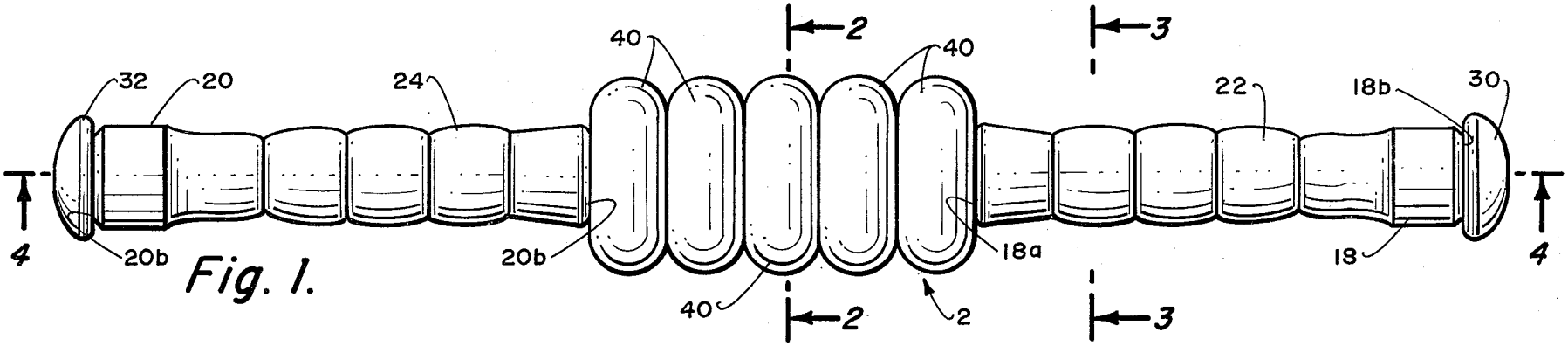
FIG. 1 is an elevation, front view of the device of the invention.
Figure 2:
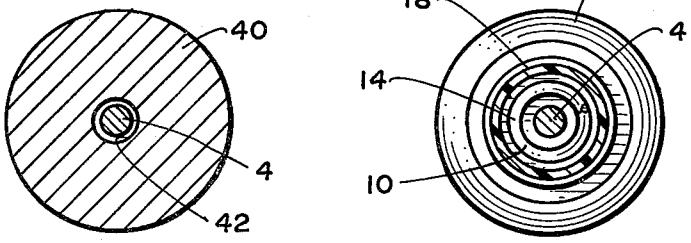
FIG. 2 is a view taken along the line 2—2 of FIG. 1.
Figure 3:
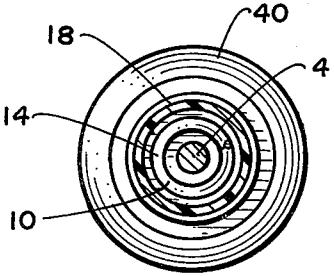
FIG. 3 is a view taken along the line 3—3 of FIG. 1.

Referring to the figures of the drawings, it will be noted that the exercise-device 2 comprises an extending elongate member 4 in this particular instance taking the form of a metal, cylindrical tube having threaded ends 6 and 8 to which is secured spaced, collar, annular members 10 and 12 press-fitted or otherwise secured, a sufficient distance from the threaded ends 6 and 8 so as to mount therebetween helical biasing means or springs 14 and 16.

Disposed about and over the helical springs 14 and 16 are end or handle members 18 and 20 in this particular case, of integral, molded construction having a knurled or finger-grip surface 22 and 24 for handle members 18 and 20, respectively.

The handle members 18 and 20 are of generally hollow cylindrical design having depending wall portions 18*a* and 20*a* extending about the metal collar members or abutments 10 and 12. The opposed open ends 18*b* and 20*b* of handle members 18 and 20, respectively, are threaded as shown so as to receive end cap members 30 and 32, respectively.

Carried between handle members 18 and 20 is at least one rotatable member and in the particular device 2 as illustrated, a plurality of roller or annular members 40 in this particular case, having a circular configuration and having a central aperture 42 therethrough, so as to be easily mounted on the shaft or rod 4. The members 40, while shown in a plurality, may of course be singular, and may be cylindrical in shape or doughnut as shown, depending upon the desired massaging action to be obtained.

Figure 5:
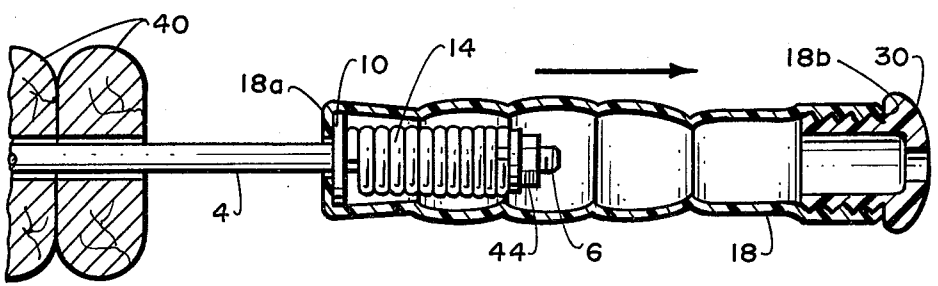
FIG. 5 is a fragmented view similar to FIG. 4, but showing the manner in which the handle members may be distended against the spring-biasing force in the direction of the arrow as indicated.
Figure 4:
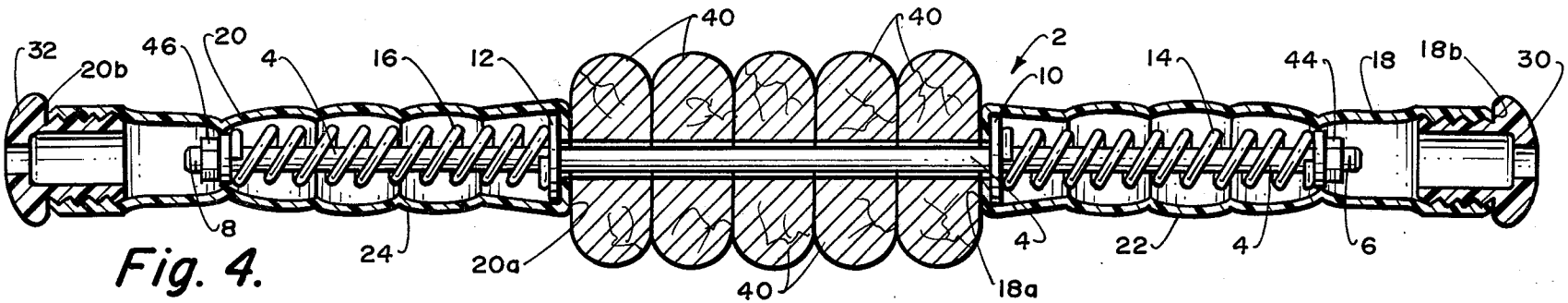
FIG. 4 is a view taken along the line 4—4 of FIG. 1 illustrating more detail of construction of the device of the invention.

It will be noted that the springs 14 and 16, by reason of being confined between nuts 44 and 46 on threaded ends 6 and 8, abut the nuts and the respective collars 10 and 12 so that distention thereof in the direction of the arrow as pictured in FIG. 5, will cause compression of the spring so that movement of the handle by grasping same with the human hand, will impart resistance so as to obtain exercising of the fingers, hand, arm muscles, shoulders and upper body portion of the user thereof.

Contrariwise, grasping each of the handles 18 and 20 with each hand of a human will allow the device 2 to be used in the exercising fashion as is readily apparent or, alternatively, its use as a massage-device much like a rolling pin or the like, would be maneuvered. However, in this particular case, because of the plurality of roller elements, a gentle massaging action is obtained and, while the elongate member or shaft 4 has been shown as being of metal construction, it is, of course, in some instances desirable to have a flexible shaft or rod whether it be made out of rubber or elastomeric or other resilient material, so that the roller members and, indeed, the handles, would not be so rigidly mounted.

There has thus been described an exercise-massaging device that is easily constructed, unsophisticated in elements making up the totality thereof, and not requiring maintenance or upkeep in order to make the device useful.

While the device has been illustrated with a plurality of rollers and a rigid rod or shaft member mounting same, as well as the handles, those of ordinary skill in the art will at once recognize that there are other means of mounting the handles in a biasing fashion in order to achieve the exercising component of the device and/or the utilization of other type of massaging roller elements so as to achieve the desired end functions as alluded to and as can be readily seen by reference to the hereinbefore commentary and drawings referring to the invention.

All modifications and changes will at once become apparent to those of ordinary skill in the art and all such changes and modifications are intended to be covered by the appended claims.

I claim:

1. A hand-held exercise-massage device comprising the combination: an elongate support member defining an axis, handle members slidably mounted on said elongate support member in the vicinity of opposite ends thereof and being capable of being grasped by the human hand, at least one rotatable element having an aperture therein for receiving said elongate support member and being rotatably and centrally mounted thereon between and independently of said handle members and being of a size greater in diameter than said handle members and adapted to impart a massaging action, and spring-biasing means cooperatively engaging each of said handle members so as to provide resilient resistance to said handle members during movement along said axis, said handle members being capable of movement along said axis toward and away from and independently of said at least one rotatable element.

2. The exercise-massage device in accordance with claim 1 wherein said elongate support member is rigid.

3. The exercise-massage device in accordance with claim 2 wherein each handle member carries a spring member mounted therein to urge said handle member towards said at least one rotatable element.

4. The exercise-massage device in accordance with claim 3, including a plurality of rotatable elements which are annular in configuration.

5. The exercise-massage device in accordance with claim 4 wherein said handle members are of cylindrical configuration and include end cap members.

6. The exercise-massage device in accordance with claim 5 wherein said elongated support member is a metal rod.

7. The exercise-massage device in accordance with claim 6 wherein said handle members are of molded plastic.

8. The exercise-massage device in accordance with claim 7 wherein said rotatable elements are of wood construction and said handle members are capable of being distended relative to each other a sufficient distance to obtain exercising action by the user thereof.

9. The exercise-massage device in accordance with claim 1 wherein said elongate support member is flexible.

* * * * *